US006279177B1

(12) United States Patent
Gloodt

(10) Patent No.: US 6,279,177 B1
(45) Date of Patent: Aug. 28, 2001

(54) METHOD AND APPARATUS FOR PURGING WATER FROM A WHIRLPOOL SYSTEM

(76) Inventor: Cary Gloodt, 2889 Spring Meadow Ct., Indianapolis, IN (US) 46268

( * ) Notice: Subject to any disclaimer, the term of this patent is extended or adjusted under 35 U.S.C. 154(b) by 0 days.

(21) Appl. No.: 09/544,157

(22) Filed: Apr. 6, 2000

(51) Int. Cl.[7] ..... A47K 3/00; A47K 3/10

(52) U.S. Cl. ..... 4/541.1; 4/541.3; 4/541.4; 4/541.5; 601/157

(58) Field of Search ..... 4/492, 541.1–541.5; 601/156–158

(56) References Cited

U.S. PATENT DOCUMENTS

| | | | | |
|---|---|---|---|---|
| 3,964,472 | * | 6/1976 | Nicollet | 601/157 |
| 4,563,781 | | 1/1986 | James | 4/542 |
| 4,857,112 | * | 8/1989 | Franninge | 4/541.1 |
| 5,012,535 | | 5/1991 | Klotzbach | 4/541 |
| 5,383,239 | | 1/1995 | Mathis et al. | 4/541 |
| 5,862,545 | | 1/1999 | Mathis et al. | 4/662 |
| 5,865,601 | | 2/1999 | Miller | 417/2 |
| 5,896,597 | | 4/1999 | Kurth et al. | 4/541.6 |
| 6,199,224 | * | 3/2001 | Versland | 4/541.4 |

FOREIGN PATENT DOCUMENTS

| | | | |
|---|---|---|---|
| 0 519 572-A1 | * | 12/1992 | (EP) . |
| 5-309052 | * | 11/1993 | (JP) . |

OTHER PUBLICATIONS

Royal Spa Product Brochure, Royal Spa Manufacturing, 2041 West Epler Avenue, Indianapolis, Indiana 46217 Brochure circa Nov. 1998 showing whirlpool bathtub systems featuring aerated water jet nozzles.

* cited by examiner

*Primary Examiner*—Gregory L. Huson
*Assistant Examiner*—Tuan Nguyen
(74) *Attorney, Agent, or Firm*—Woodard, Emhardt, Naughton, Moriarty & McNett

(57) ABSTRACT

An apparatus for removing standing water from the hydraulic plumbing system that circulates water in a whirlpool bath. The apparatus includes a pneumatic pump fluidically coupled to the whirlpool hydraulic plumbing system of a whirlpool bathtub, such that air pressure from the pneumatic pump can be used to flush standing water out of the hydraulic plumbing after each use of the whirlpool bathtub. The pneumatic plumbing connecting the air pump to the hydraulic plumbing system is positioned substantially above the maximum water level allowed in the tub and also substantially above the hydraulic plumbing system. The pneumatic plumbing is connected in fluidic communication with different portions of the hydraulic plumbing, such that activation of the pneumatic pump (after the tub has been substantially drained) forces residual water from the whirlpool hydraulic plumbing system into the bathtub, where it can be conventionally drained.

14 Claims, 3 Drawing Sheets

METHOD AND APPARATUS FOR PURGING WATER FROM A WHIRLPOOL SYSTEM

TECHNICAL FIELD OF THE INVENTION

The present invention relates generally to whirlpools and spas, and, more particularly, to a method and apparatus for purging standing water from the water lines, fixtures, and jet manifolds during draining of the whirlpool or spa vessel.

BACKGROUND OF THE INVENTION

A whirlpool bath or spa typically includes a tub in which the water is circulated around the bather to provide a relaxing and therapeutic environment. Whirlpool baths generally accomplish this through the use of a hydraulic pump to circulate water from the interior of the bathtub through plumbing located on the exterior of the bathtub and back into the tub through a plurality of nozzles. Whirlpool baths can be commonly found in homes, health clubs, hospitals, and rehabilitation centers.

One concern currently receiving some attention regarding the safety of whirlpool baths relates to sanitation. Specifically, there is a concern that it is difficult to completely drain all of the water from the whirlpool circulation plumbing, resulting in an environment conducive to the growth of bacteria and fungi. Since the plumbing is principally located outside of the bathtub (and is usually covered), the plumbing is generally inaccessible without undertaking the major effort of disassembling and removing the tub itself. The inaccessibility of the plumbing makes it nearly impossible to prevent standing water from being left therein after each use of the whirlpool bath. This is a problem because the standing water typically includes residual soap scum, scale deposits, sloughed off skin cells, body oils and other fluids, fecal matter, and other bathing residue. The plumbing therefore provides a dark, warm, and moist environment in which bacteria and fungi may thrive.

One recent study conducted by Dr. Rita Moyes of the Texas A&M University Department of Biology indicates that in addition to fungi, enteric organisms (Enterobacteriaceae), Pseudomonas sp., Legionella sp. (the causative agent of Legionnaire's disease and Pontiac fever) and Staphylococcus aureus may be found in such systems. "Microbial Loads in Whirlpool Bathtubs: An Emerging Health Risk", Moyes, unpublished report. According to Dr. Moyes, these bacteria cause 30–35% of all septicemias, more than 70% of all urinary tract infections, impetigo, folliculitis, and carbuncles and have been implicated in infections of the respiratory tract, burn wounds, ears, eyes, and intestines. Id. *S. aureus* is an etiological agent for bacteremia, endocarditis, pneumonia, empyema, osteomyletis, and septic arthritis and also releases a toxin responsible for scalded skin syndrome, toxic shock syndrome, and food poisoning. Id.

One method known in the art of sanitizing a whirlpool bathtub is to drain and clean the circulation plumbing. However, complete draining of conventional whirlpools can only be accomplished through their disassembly. Alternately, sanitization of whirlpool plumbing has been attempted through the circulation of cleaning fluids therethrough, but this technique is largely ineffective without the use of expensive specialized equipment to heat, convey and concentrate special cleaning solutions therethrough. The simple addition of disinfectants or cleaning solutions to the water in the tub and the subsequent circulation of the water through the plumbing by actuation of the circulation pump has only a marginal effect on disinfecting the residual water left therein.

Obviously, it would be desirable to eliminate standing dirty water in whirlpool plumbing as a possible source of disease to the bather. The present invention is directed toward achieving this goal.

SUMMARY OF THE INVENTION

The present invention relates to a method and apparatus for removing standing water from the plumbing in a whirlpool bath. One form of the present invention is a pneumatic pump fluidically coupled to the pipes and nozzles of the hydraulic piping of a whirlpool bath and adapted to flush standing water out of the hydraulic plumbing after each use of the bath. The pneumatic plumbing is positioned substantially above the maximum water level allowed in the tub and substantially above the hydraulic plumbing and is connected in fluidic communication with different portions of the hydraulic plumbing, such that activation of the pneumatic pump after the tub has been substantially drained forces residual water from the hydraulic plumbing.

One object of the present invention is to provide an improved whirlpool bath system. Related objects and advantages of the present invention will be apparent from the following description.

DETAILED DESCRIPTION OF THE PREFERRED EMBODIMENT

Figure 1:
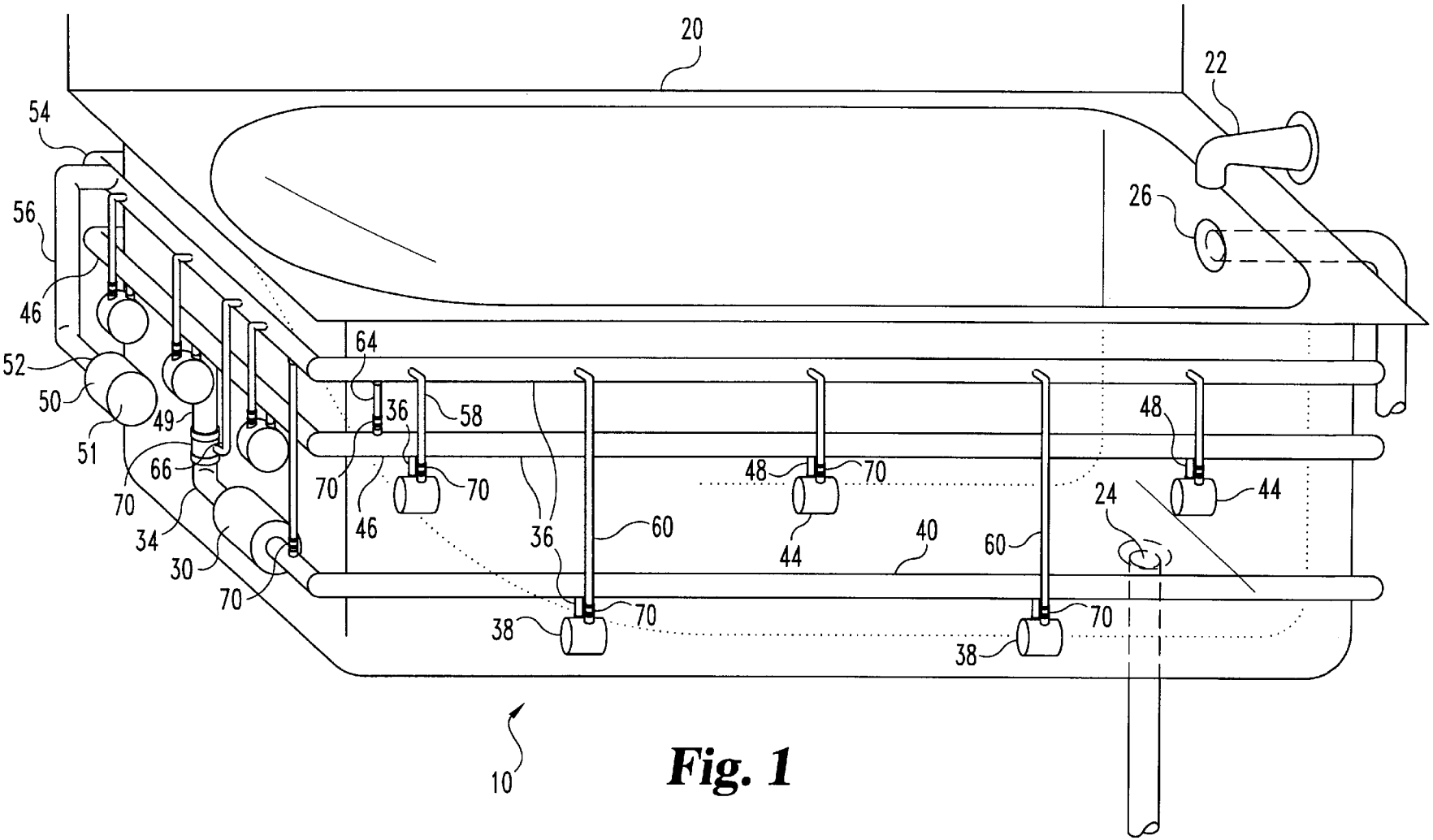
FIG. 1 is a perspective view of a whirlpool bathtub fitted with a residual water purging system of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Figure 2:
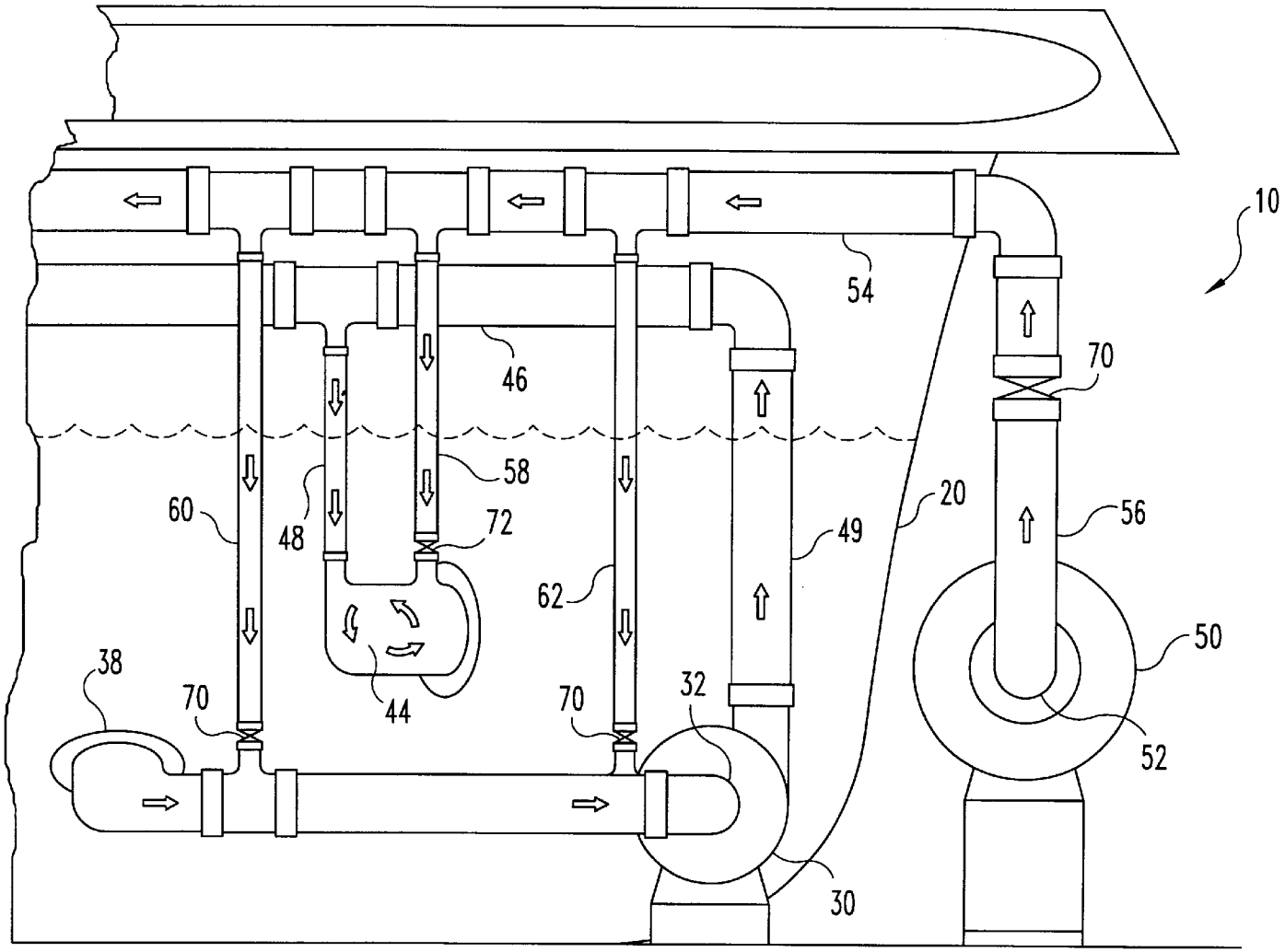
FIG. 2 is an enlarged partial perspective view of a portion of the residual water purging system of FIG. 1.

FIGS. 1 and 2 illustrate one embodiment of the present invention, a system 10 for purging residual water from the whirlpool plumbing of a whirlpool bathtub. The water purging system 10 is adapted to use air pressure to blow residual or standing water from the water circulation plumbing used to generate the "whirlpool" effect in a whirlpool bathtub 20. The whirlpool bathtub 20 typically includes a water inlet 22 and a water outlet or drain 24 connected to a central plumbing system. The whirlpool bathtub 20 preferably includes an auxiliary water outlet/drain 26 positioned substantially above the water drain 24. (As used herein, "above" means positioned farther away in a direction opposite the pull of gravity; a first object positioned "above" a second object of identical mass would have more gravitational potential energy and would have farther to fall before reaching a common gravitational source.) The auxiliary drain 26 functions to prevent an overflow of the bathtub 20, and effectively defines a maximum water level. However, the bathtub 20 may alternately include a single water drain 24 without an auxiliary drain 26.

A typical whirlpool bathtub 20 also includes a water pump 30 having a water pump inlet 32 and a water pump outlet 34. The water pump outlet 34 is connected in hydraulic communication with a whirlpool hydraulic system of plumbing 36 and is adapted to pump water therethrough when actuated while the bathtub 20 is filled with water.

The whirlpool hydraulic system 36 typically includes at least one suction fitting 38 formed through the bathtub 20. A suction conduit 40 extends from the suction fitting 38 to the water pump inlet 32, connecting the suction fitting 38 (and therethrough the bathtub 20) in hydraulic communication to the water pump 30. A plurality of water inlet or water jet nozzles 44 are also typically formed in the bathtub 20. A water manifold 46 is typically positioned around the bathtub 20 and is preferably positioned above the water level defined by the auxiliary drain 26. The water manifold 46 is connected in hydraulic communication to the plurality of water jet nozzles 44 by a plurality of water delivery conduits 48, each adapted to convey water from the water manifold 46 through the respective water jets 44 and into the bathtub 20. The water manifold 46 is also connected to the water pump outlet 34 by a water manifold conduit 49 extending therebetween in hydraulic communication. When actuated, the water pump 30 is adapted to receive water from the bathtub 20 through the suction fitting 38 and suction conduit 40 and return water under pressure into the bathtub 20 through the jet nozzles 44 by way of the water manifold 46.

The water purging system 10 of the present invention includes an air pump 50 having an air pump inlet 51 and an air pump outlet 52. The air pump outlet 52 is connected in pneumatic communication to an air manifold 54 through an air delivery conduit 56 extending therebetween. The air manifold 54 preferably extends around the bathtub 20 and is more preferably positioned above the water manifold 46. A plurality of air nozzle conduits 58 extend from the air manifold 54 to each respective water jet nozzle 44, connecting the air manifold 54 thereto in pneumatic communication. Preferably, an air suction fitting conduit 60 extends from the air manifold 54 to the suction fitting 38, connecting the air manifold 54 in pneumatic communication to the suction fitting 38. More preferably, an air suction conduit conduit 62, and air water manifold conduit 64 and an air water pump outlet conduit 66 extend between the air manifold 54 and the suction conduit 40, the water manifold 46, and the water pump outlet 34, respectively, connecting the air manifold 54 in pneumatic communication thereto. Still more preferably, the air manifold 54 is connected to the hydraulic plumbing system 36 through valves 70 (preferably check valves) adapted to allow air to flow into the hydraulic plumbing system 36 and to prevent water from flowing from the hydraulic plumbing system 36 into the air manifold 54. However, the air pump 50 may be coupled to the hydraulic plumbing system 36 in any convenient configuration that provides air pressure to the hydraulic plumbing system 36 sufficient to blow any standing water left in the hydraulic plumbing system 36 into the whirlpool bathtub 20 where it can be drained.

Figure 3:
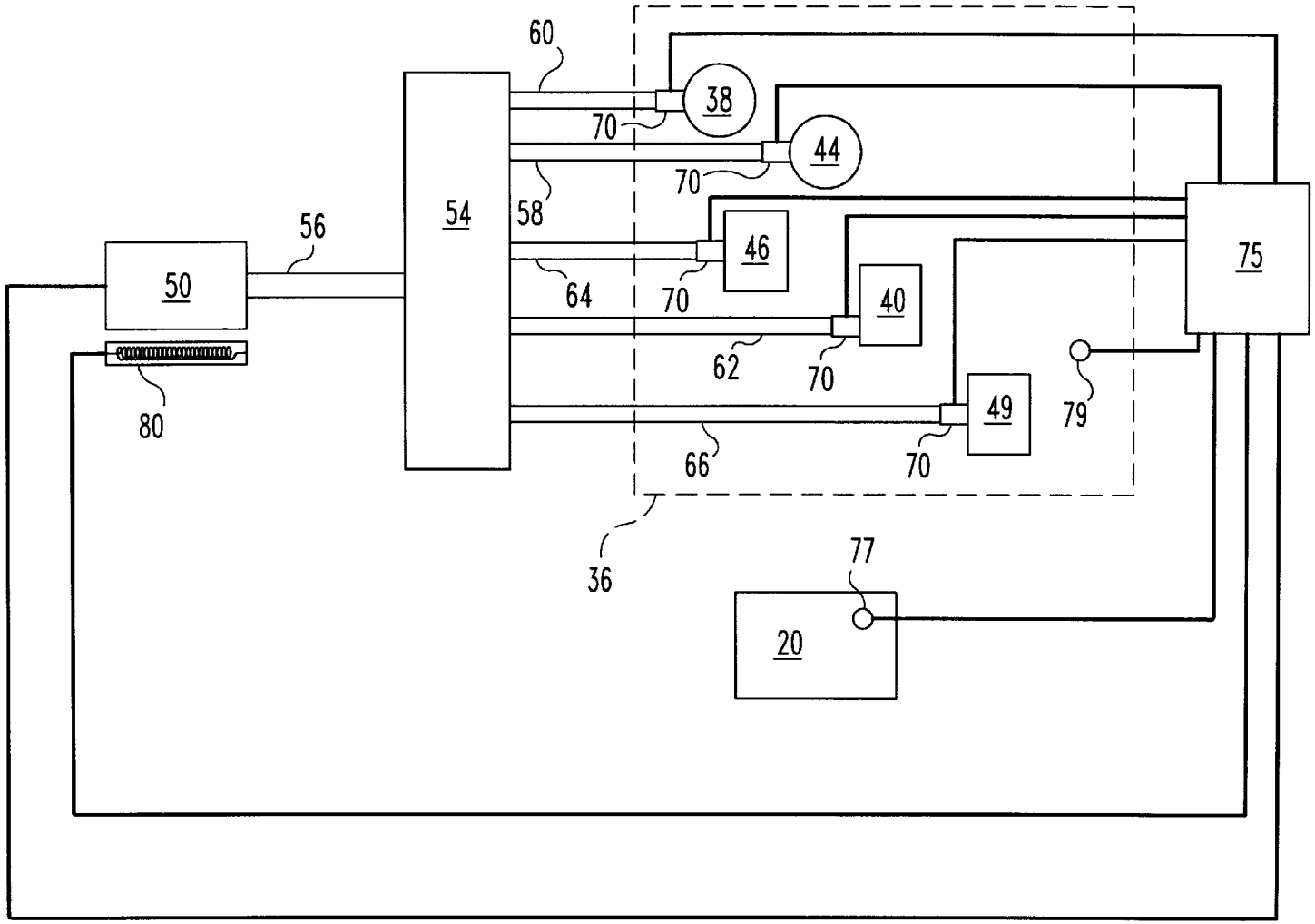
FIG. 3 is a schematic view of the residual water purging system of the present invention.

FIG. 3 schematically illustrates the whirlpool water purging system 10 of the present invention in greater detail. The air pump 50 is connected to the air manifold 54 through the air delivery conduit 56. The air manifold 54 is connected to one or more of the various components of the whirlpool hydraulic plumbing circuit 36 (including the suction fitting(s) 38, the suction conduit 40, the water jet nozzles 44, the water manifold 46, and/or the water manifold conduit 49) through one or more air conduits 58, 60, 62, 64 and 66. An electronic controller 75 may be operationally coupled to the air pump 50 to facilitate automatic or manual actuation thereof. For example, a sensor 77 may be positioned in the bathtub 20 and adapted to send a signal to the electronic controller when the bathtub 20 is drained or when the water temperature passes a predetermined threshold. Upon receipt of the signal, the electronic controller 75 activates the air pump 50 for a predetermined length of time. Alternately, a sensor 77 may be positioned in whirlpool hydraulic plumbing circuit 36 and adapted to send a signal to the electronic controller 75 in the presence of a predetermined amount of moisture. Upon receipt and for the duration of the signal, the electronic controller 75 actuates the air pump 50 to supply a stream of pressurized air flowing through the whirlpool hydraulic plumbing system 36.

The electronic controller 75 may also be operationally connected to a heater 80. The heater 80 is preferably positioned so as to be operationally coupled to the air pump 50, and is adapted to provide sufficient heat output to substantially heat the air flowing through the air pump 50 and through the air manifold 54, such that warm, dry air is provided to the whirlpool hydraulic plumbing system 36. The heater 80 may be slaved to the air pump 50 such that the heater 80 heats the air flowing through the air pump 50 whenever the air pump 50 is running. Alternately, the heater 80 may be independently controlled.

The electronic controller 75 may also be operationally coupled to any or all of the check valves 70, such that each of the check valves 70 may be independently operated. Independent operation of the check valves 70 allows the output of the air pump 50 to be concentrated as desired in the whirlpool hydraulic system 36. For example, while the bathtub 20 is filled with water, the check valves 70 connecting the air manifold 54 to the water inlet jets 44 may be opened and the remaining valves 70 may be closed, to concentrate the air flow through the water inlet jets 44. When the bathtub is drained, all of the check valves 70 may be opened to facilitate the rapid purging of water from the whirlpool hydraulic plumbing system 36. In one contemplated embodiment, a series of moisture sensors 77 may be positioned throughout the whirlpool hydraulic plumbing system 36 and operationally coupled to an electronic controller 75, such that the check valves 70 may be opened and closed to concentrate air flow through those portions of the hydraulic plumbing system 36 still containing moisture. In other words, the check valves 70 may be manipulated to maximize drying efficiency.

In operation, the water purging system 10 of the present invention supplies air pressure to the whirlpool hydraulic plumbing system 36 sufficient to purge remaining standing water left in the whirlpool hydraulic plumbing system 36. If the bathtub 20 is filled with water, actuation of the air pump 50 supplies pressurized air that may be used to aerate the water flowing through the water jet nozzles 44. When the water is substantially drained from the bathtub 20 and the whirlpool hydraulic plumbing system, actuation of the air pump 50 supplies pressurized air that may be directed through the whirlpool hydraulic plumbing system 36 to force substantially all of the residual water out of the hydraulic plumbing system 36. The air pump 50 may further be used to air dry the hydraulic plumbing system 36 by circulating a stream of pressurized air therethrough until the hydraulic plumbing system 36 is substantially dry. The effectiveness of the air-drying process may be enhanced by circulating heated air through the whirlpool hydraulic plumbing system 36.

The water purging system 10 of the present invention may be retrofitted to existing whirlpool hydraulic plumbing systems 36, or may be included therewith as part of a new whirlpool bathtub 20.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A system for purging residual water from the whirlpool plumbing of a whirlpool bath, comprising:

a bathtub;

a primary water inlet in hydraulic communication with the bathtub;

a primary water outlet in hydraulic communication with the bathtub;

an auxiliary water outlet in hydraulic communication with the bathtub and positioned to define a maximum water level;

a hydraulic pump having a water outlet port and a water inlet port;

a pneumatic pump having an air inlet port and an air outlet port;

at least one suction fitting formed in the bathtub;

at least one hydraulic suction conduit extending between the at least one suction fitting to the water inlet port and connecting the at least one suction fitting in hydraulic communication to the water inlet port;

at least one water delivery jet nozzle formed in the bathtub;

a water manifold substantially positioned above the maximum water level;

a water manifold conduit extending between the water outlet port and the water manifold and connecting the water outlet port to the water manifold in hydraulic communication therewith;

at least one water delivery conduit extending between the water manifold and the at least one water delivery jet nozzle and connecting the water manifold to the at least one water delivery jet nozzle in hydraulic communication therewith;

an air manifold positioned above the water manifold;

an air pump delivery conduit extending between the air pump outlet and the air manifold and connecting the air pump outlet in pneumatic communication with the air manifold;

at least one air nozzle conduit extending between the air manifold and the at least one water delivery jet nozzle and connecting the air manifold in pneumatic communication to the at least one water delivery jet nozzle;

at least one air suction conduit extending between the air manifold and the at least one suction fitting and connecting the air manifold in pneumatic communication to the at least one suction fitting;

wherein when the bathtub is substantially filled with water and the hydraulic pump is actuated to produce water jets from the at least one water delivery jet nozzle, the air pump may be actuated to introduce air into the water jets to soften the water jets;

wherein when the bathtub is substantially drained, the air pump may be actuated to introduce air into the at least one water delivery jet, the at least one suction fitting, the water manifold, the at least one water delivery conduit, and the at least one hydraulic suction conduit to purge residual water therefrom.

2. The system of claim 1 further including a first check valve connected in fluid communication between the air manifold and the at least one water delivery jet and a second check valve connected in fluid communication between the air manifold and the at least one hydraulic suction conduit.

3. The system of claim 1 further including a sensor positioned to detect when the bathtub has been drained after use and adapted to send a signal when the bathtub has been drained after use; and an electronic controller operationally connected to the sensor and to the air pump; wherein the electronic controller is adapted to actuate the air pump for a predetermined period of time upon receiving the signal from the sensor.

4. The system of claim 1 further including at least one check valve connected between the air pump outlet and the air manifold.

5. The system of claim 1 further including at least one moisture sensor positioned in the at least one hydraulic suction conduit and adapted to send a signal when ambient moisture is above a predetermined level; wherein the sensor is operationally connected to the air pump; and wherein the air pump is adapted to remain actuated for the duration of receipt of the signal.

6. The system of claim 1 wherein the air pump is adapted to selectively blow heated and unheated air.

7. The system of claim 6 wherein when the bathtub is drained, the air pump is adapted to blow heated air through the at least one water delivery jet nozzle, the at least one suction fitting, the water manifold, the at least one water delivery conduit, and the at least one hydraulic suction conduit until they are substantially dry.

8. The system of claim 1 further including a plurality of check valves connected between the air pump outlet and the air manifold and an electronic controller operationally connected to the respective check valves, wherein the electronic controller is adapted to selectively actuate the respective check valves.

9. A whirlpool system, comprising;

a water pump for circulating water in a whirlpool tub;

a hydraulic plumbing system in hydraulic communication with the water pump, the hydraulic plumbing system comprising:

a plurality of jet outlet nozzles;

at least one suction inlet fitting;

a first hydraulic plumbing subsystem connecting the at least one suction inlet fitting to the water pump; and a second hydraulic subsystem connecting the water pump to the plurality of jet outlet nozzles;

an air manifold positioned above the hydraulic plumbing system;

an air pump adapted to provide positive air pressure to the hydraulic plumbing system connected in fluid communication with the hydraulic plumbing system; and at least one air suction conduit extending from the air manifold and connecting between the at least one suction inlet fitting and the water pump to connect the air manifold in pneumatic communication to the at least one suction inlet fitting;

wherein the air pump can be actuated to purge standing water from the plurality of jet outlet nozzles, the at least one suction inlet fitting, and the first and second hydraulic subsystems.

10. The whirlpool system of claim 9 wherein actuation of the air pump to purge standing water from the hydraulic plumbing system acts to blow the system dry.

11. The whirlpool system of claim 9 further including a plurality of check valves operationally coupling the air pump to the hydraulic plumbing system to allow air to flow from the air pump into the hydraulic plumbing system and to prevent water from flowing from the hydraulic plumbing system to the air pump.

12. The whirlpool system of claim 11 further including an electronic controller operationally connected to the plurality of check valves and adapted to selectively actuate the respective check valves.

13. The whirlpool system of claim 9 wherein the air pump is connected to the hydraulic system adjacent the water pump.

14. The whirlpool system of claim 9 wherein the air pump is adapted to selectively provide heated and unheated air.

* * * * *